US011540639B2

(12) United States Patent
Holland

(10) Patent No.: US 11,540,639 B2
(45) Date of Patent: Jan. 3, 2023

(54) COLLAPSIBLE SHELTERED BENCH

(71) Applicant: QUICK PLAY SPORT LTD, Sheffield (GB)

(72) Inventor: Allen Keith Holland, Sheffield (GB)

(73) Assignee: QUICK PLAY SPORT LTD, Sheffield (GB)

( * ) Notice: Subject to any disclaimer, the term of this patent is extended or adjusted under 35 U.S.C. 154(b) by 0 days.

(21) Appl. No.: 17/271,393

(22) PCT Filed: Aug. 28, 2019

(86) PCT No.: PCT/GB2019/052402
§ 371 (c)(1),
(2) Date: Feb. 25, 2021

(87) PCT Pub. No.: WO2020/044038
PCT Pub. Date: Mar. 5, 2020

(65) Prior Publication Data

US 2021/0321782 A1 Oct. 21, 2021

(30) Foreign Application Priority Data

Aug. 30, 2018 (GB) ..... 1814120

(51) Int. Cl.
*A47C 7/66* (2006.01)
*A47C 4/28* (2006.01)
(Continued)

(52) U.S. Cl.
CPC ..... *A47C 7/66* (2013.01); *A47C 1/12* (2013.01); *A47C 1/124* (2013.01); *A47C 4/28* (2013.01);
(Continued)

(58) Field of Classification Search
CPC ..... A47C 11/00; A47C 1/12; A47C 1/124; A47C 4/28; A47C 4/286; A47C 4/38;
(Continued)

(56) References Cited

U.S. PATENT DOCUMENTS 1,196,207 A * 8/1916 Cane ..... E04H 15/003 297/184.12
1,903,579 A * 4/1933 Taylor ..... A47C 7/664 194/254
(Continued)

FOREIGN PATENT DOCUMENTS

DE 3227119 A1 2/1983
WO 2006099718 A1 9/2006

OTHER PUBLICATIONS

International Search Report (ISR) for PCT/GB2019/052402 dated Nov. 21, 2019 (3 pages).
(Continued)

*Primary Examiner* — Robert Canfield
(74) *Attorney, Agent, or Firm* — Shumaker, Loop & Kendrick, LLP

(57) ABSTRACT

A collapsible sheltered bench operable to have a first collapsed configuration and a second erect configuration. The sheltered bench includes a base member comprising a bench surface for sitting. The sheltered bench further includes a canopy member having first and second support members and a cover. In the erect configuration the first and second support members extend from a first side of the sitting surface to a second substantially opposed side of the sitting surface along opposite sides of the longitudinal axis of the sitting surface. The first and second support members support the cover such that the cover extends over at least a portion of the sitting surface.

16 Claims, 15 Drawing Sheets

(51) Int. Cl.

| | |
|---|---|
| ***A47C 4/48*** | (2006.01) |
| ***A47C 11/00*** | (2006.01) |
| ***A47C 1/12*** | (2006.01) |
| ***A47C 1/124*** | (2006.01) |
| ***A47C 4/38*** | (2006.01) |

(52) U.S. Cl.
CPC ..... *A47C 4/286* (2013.01); *A47C 4/38* (2013.01); *A47C 4/48* (2013.01); *A47C 7/664* (2018.08); *A47C 11/00* (2013.01); *A47C 7/666* (2018.08)

(58) Field of Classification Search
CPC ..... A47C 4/48; A47C 7/664; A47C 7/666; A47C 7/66; A47C 11/005
USPC ..... 297/16, 42, 45, 184.11, 184.15, 184.17; 5/113, 414
See application file for complete search history.

(56) References Cited

U.S. PATENT DOCUMENTS

| | | | | | |
|---|---|---|---|---|---|
| 2,137,427 | A * | 11/1938 | Roy | A47C 7/38 | 297/23 |
| 3,619,827 | A * | 11/1971 | MacKenzie | E04H 15/324 | 135/156 |
| 3,757,360 | A * | 9/1973 | Wescott | E04H 15/324 | 135/96 |
| 4,846,204 | A * | 7/1989 | Sok Kyu | E04H 15/50 | 52/109 |
| 4,915,120 | A * | 4/1990 | Ziolkowski | A47C 7/66 | 135/117 |
| 6,925,664 | B1 * | 8/2005 | Twigg | A01K 1/034 | 5/112 |
| 7,427,101 | B1 * | 9/2008 | Zernov | A47C 7/666 | 297/16.2 |
| 7,648,196 | B2 * | 1/2010 | Degelman | A47C 4/286 | 297/184.11 |
| 7,698,756 | B1 * | 4/2010 | Chen | A47C 29/003 | 135/96 |
| 7,753,063 | B1 * | 7/2010 | Laws | A47C 7/66 | 135/117 |
| 9,131,778 | B2 * | 9/2015 | Jin | A47C 17/72 | |
| 9,215,935 | B2 * | 12/2015 | Surek | A47C 7/66 | |
| 9,383,113 | B1 * | 7/2016 | Renwick | A47C 7/666 | |
| 10,040,470 | B1 * | 8/2018 | Horowitz | B62B 3/102 | |
| 10,871,007 | B1 * | 12/2020 | Tsai | E04H 15/50 | |
| D911,050 | S * | 2/2021 | Uezu | D6/334 | |
| 2002/0185896 | A1 * | 12/2002 | Tseng | A47C 7/66 | 297/184.15 |
| 2004/0207240 | A1 | 10/2004 | Tondino | | |
| 2008/0283105 | A1 * | 11/2008 | DuBose, III | A45B 11/00 | 135/141 |
| 2009/0007947 | A1 * | 1/2009 | Spangenberg | G01N 33/5438 | 135/96 |
| 2009/0140556 | A1 * | 6/2009 | Degel | A47C 11/00 | 297/16.2 |
| 2009/0179463 | A1 * | 7/2009 | Fargason, III | A47C 7/66 | 297/16.2 |
| 2011/0175407 | A1 * | 7/2011 | Sharapov | A47C 7/66 | 297/184.15 |
| 2021/0145179 | A1 * | 5/2021 | Kong | A47C 11/005 | |
| 2021/0321781 | A1 * | 10/2021 | Silinski | A47C 7/624 | |
| 2021/0345779 | A1 * | 11/2021 | Truong | A47C 7/624 | |

OTHER PUBLICATIONS

Written Opinion (WO) for PCT/GB2019/052402 dated Nov. 21, 2019 (12 pages).
International Preliminary Report on Patentability (IPRP) for PCT/GB2019/052402 dated Mar. 2, 2021 (7 pages).

* cited by examiner

COLLAPSIBLE SHELTERED BENCH

FIELD

The present invention relates to a collapsible sheltered bench. More specifically, the present invention relates to a collapsible sheltered bench having a removable canopy.

BACKGROUND

Portable seating is often required for use in areas where permeant seating is not practical or cost effective. One example is during sporting events, which often take place in large fields with no seating provisions over a long period of time. Portable seating allows for spectators and players to have seating for during the event which can be removed once the event has finished.

Such events often take place outside and many occur in the winter months. As such, it is also desirable that as well as providing portability, the portable seating provides some form of shelter against adverse weather conditions, such as rain and wind.

A canopy extending over the seating can be used to provide such shelter, however the addition of a canopy to portable seating raises several problems, including the significant addition of weight and bulkiness; the reliability of the structural integrity of the canopy, which is by design exposed to the adverse weather; and increased cost.

Therefore, there is a requirement for an improved collapsible sheltered bench. It is therefore an object of aspects of the present invention to address one or more of the abovementioned or other problems.

SUMMARY

According to a first aspect of the present invention, there is provided a collapsible sheltered bench operable to have a first collapsed configuration and a second erect configuration, the sheltered bench comprising a base member comprising a bench surface for sitting, and a canopy member comprising first and second support members and a cover, wherein in the erect configuration the first and second support members extend from a first side of the sitting surface to a second substantially opposed side of the sitting surface along opposite sides of the longitudinal axis of the sitting surface, and wherein the first and second support members support the cover such that the cover extends over at least a portion of the sitting surface.

The sheltered bench may be a portable collapsible sheltered bench. Preferably the sheltered bench is a collapsible sheltered sports team bench.

The base member may be a collapsible base member operable to be moved from a first open position in which the sitting surface is suitable for sitting to a second collapsed position in which the base member is compact compared to the first position. Preferably, the base member is operable to be folded from the first position to the second position.

The base member may comprise a plurality of repeating support units. The support units of the base member may each comprise at least two pairs of support members wherein the support members of each pair are pivotally connected together such that each pair of support members are operable to move from a spaced configuration in the first open position of the base member to an adjacent configuration in the second compact position, suitably each pair of support members are pivotally connected together at about the midpoint of the support members. Preferably, the support members are operable to be slanted in the first open position, more preferably with a longitudinal axis orientated at from 60° to 30° off-set from vertical, such as from 55° to 35° off-set from vertical or from 50° to 40° off-set from vertical. The support members may be operable to be substantially vertically orientated in the second compact position.

The support units may each comprise a first longitudinally extending pivotally connected pair of support members and a first laterally extending pivotally connected pair of support members, with respect to the sitting surface. Suitably, the support units each comprise first and second longitudinally extending pivotally connected pairs of support members, suitably arranged at the front and rear of the sitting surface, and first and second laterally extending pivotally connected pairs of support members extending between the first and second longitudinally extending pivotally connected pairs of support members. Preferably, adjacent support units share the same pair of laterally extending pivotally connected pairs of support members.

The base member may comprise joining members that attach the pairs of support members within a support unit and suitably also attach adjacent support units. Suitably, the joining member comprises pivotal connections to a support member from each of a longitudinally extending pair and a laterally extending pair, preferably the joining member additionally has a pivotal connection to a support member from a further longitudinally extending pair.

The base member may further comprise vertical support members extending between joining members, preferably the base member comprises front vertical support members arranged toward the front of the sitting surface and rear vertical support members arranged toward the rear of the sitting surface. The front vertical support members may be telescopic and be operable to move from a retracted configuration when the base member in the open position to an extended configuration in which the longitudinal length is longer than in the retracted position when the base member is in the collapsed position. The front vertical support members may have fixed non-pivotal connections to the joining members. The rear vertical support member may be attached, suitably fixedly and preferably non-pivotally, at a lower end to a joining member and slidably attached to a joining member toward the upper end, wherein the vertical support member extends through and above the upper joining member to provide a backrest surface support portion. Suitably, the backrest surface support portion is operable to have a greater longitudinal length when the base member is in the open position compared to when the base member is in the collapsed position.

The base member may comprise from 3 to 20 support units, such as from 4 to 15 support units, or from 5 to 12 support units, preferably from 6 to 10 support units.

The sitting surface of the base member is suitably an elongate surface, which may be integrally formed or comprise of spaced sitting surfaces that for the purposes of this invention may collectively be considered to be the sitting surface, having a longitudinal axis extending along the longest length of the surface and a lateral axis extending perpendicularly across the longitudinal axis. The sitting surface may provide space for at least one person to sit, such as at least two, at least three, at least four or at least five people to sit.

The sitting surface may be a pliable sitting surface. Preferably, the sitting surface is operable to be held relatively taut in the first open position of the base member compared to the second collapsed position of the base member to thereby provide a surface suitable for sitting.

The sitting surface may comprise attachment portions to attach, suitably fixedly, the sitting surface to at least two joining members of the base member, preferably to at least four joining members. Preferably the sitting surface is fixedly attached to front upper joining members and is slidably attached to rear vertical support members.

The base member in the open configuration may further comprise a backrest surface. Suitably the backrest surface is integrally formed with the sitting surface. The backrest surface may comprise attachment members operable to attach the surface to the backrest surface support portion.

The base member and the canopy member may be operable to form a reversible attachment in the erect configuration. The base member and the canopy member may each comprise cooperating attachment portions operable to form an attachment between the base member and the canopy member in the erect configuration such that the cover of the canopy member extends over at least a portion of the sitting surface of the base member.

The base member in the erect configuration may comprise at least two canopy attachment members arranged at substantially opposite sides of the sitting surface. Preferably, the base member comprises a first and a second canopy attachment member at a first side of the sitting surface and a third and a fourth canopy attachment member at a second side of the sitting surface. The canopy attachment members may themselves be operable to form a reversible attachment with the base member such that the canopy attachment members may be detached from the base member in the first collapsed configuration.

The canopy attachment member of the base member may comprise a bore operable to receive a projection of the canopy member, preferably operable to receive an end of a first and/or second canopy support member. Suitably, the bore of the attachment member is operable to slidably receive the projection of the canopy member or end of the support member such as to form an attachment with the canopy member.

The longitudinal axis of the bore of the canopy attachment member may slanted when the base member is in the open configuration. Preferably, the longitudinal axis of the bore of the attachment member is slanted such that it is arranged at an angle of from 5° to 70° from vertical, preferably from 20° to 60° from vertical, more preferably from 25° to 55° from vertical, most preferably from 30° to 50° from vertical.

The first and second canopy attachment members of the base member and/or the third and fourth canopy attachment members of the base member may be off-set from vertical by substantially the same amount as the other respective attachment member, preferably off-set by substantially the same amount in the opposite direction from vertical. For example, if the first attachment member is off-set from vertical by 45° then the second attachment member may be off-set from vertical by −45°.

The first and second, and/or third and fourth canopy attachment members of the base member may be open-ended laterally extending pairs of base member support members of a support unit. Suitably, terminal laterally extending pairs of base member support members. Preferably, the support unit(s) comprising the canopy attachment members do not comprise a sitting surface.

The first and/or second support members of the canopy member may each comprise base member attachment portions operable to form an attachment with the canopy attachment portions of the base member in the erect configuration. Preferably, the first and second canopy support members each comprise two attachment portions such that the support member is operable to form attachments with the base member at substantially opposite sides of the sitting surface in the erect configuration. More preferably, the first support member comprises a first attachment member operable to form an attachment with the first attachment member of the base member and a second attachment member operable to form an attachment with the third attachment member of the base member in the erect configuration, and the second support member comprises a first attachment member operable to form an attachment with the second attachment member of the base member and a second attachment member operable to form an attachment with the fourth attachment member of the base member in the erect configuration.

The first and/or second canopy support members may be collapsible along the longitudinal length. Suitably, the support member is operable to form a first assembled configuration in which the support member has a longitudinal length and a second collapsed configuration in which the support member has a significantly reduced longitudinal length compared to the assembled configuration. When the first and/or second canopy support member is in the assembled configuration and is not attached to the base member the support member may comprise first and second substantially linear portions toward the ends of the support member and a further substantially linear intermediate portion arranged between the first and second linear portions wherein the longitudinal axis of the intermediate portion is off-set relative to the axis of the first and second linear portions.

The first and/or second canopy support members may be formed of plastic, suitably a fibre-reinforced plastic, such as fibreglass.

When the first and/or second canopy support members are attached to the base member the first and second canopy support members are preferably resiliently deformable.

In the erect configuration the first and/or second canopy support members may be held under longitudinal tension, suitably by holding the support members against the bias of the support members toward a more linear configuration than is permitted in the erect configuration.

In the erect configuration the first and second canopy support members may be held under lateral tension, suitably by holding the support members against the bias of the support members toward a greater lateral separation between the support members along their longitudinal lengths.

In the erect configuration the cover of the canopy extends over at least a portion of the sitting surface such as to shelter the sitting service from rainfall falling at least vertically about the sitting surface. Preferably, in the erect configuration the canopy extends over substantially all of the sitting surface such as to shelter the sitting service from rainfall falling at least vertically about the sitting surface. The cover of the canopy member may be pliable. Suitably the cover is operable to restrict the passage of water through the cover, as such preferably the cover is at least water resistant and preferably substantially waterproof.

In the erect configuration the cover may be held under tension, more preferably held substantially taut. Preferably, the cover is held under tension by the lateral tension of the first and second canopy support members.

The cover may be operable to form a reversible attachment with the canopy member and/or the base member. The canopy member, such as the first and/or second support members, and/or the cover and/or the base member may comprise attachment members operable to, preferably reversibly, attach the cover to the canopy and/or support members and/or base member. Preferably, the cover comprises an attachment member operable to attach the cover to the first support member, preferably reversibly attach. The cover may comprise attachment members operable to attach the cover to the rear of the base member.

According to a further aspect of the present invention there is provided a kit of parts for a collapsible sheltered bench comprising a base member according to the first aspect of the present invention and a canopy member according to the first aspect of the present invention, wherein the canopy member is operable to form a reversible attachment with the base member such as provide a cover over at least a portion of the sitting surface of the base member.

Advantageously, the collapsible sheltered bench of the present invention provides improved portability in combination with improved stability. The collapsible sheltered bench of the present invention is also cost effective. In particular the sheltered bench provides evenly distributed structural strength across the canopy combined with improved stability provided by the attachment of the canopy to the base member. The reliability of the sheltered tent is further improved due to the use of fewer components and moving parts in the canopy. The reduced components of the sheltered bench allows for improved compactness and reduced weight for better portability. In addition, the configuration of the sheltered bench of the present invention allows for significant sheltering to be provided forward of the bench without compromising on the structural integrity of the shelter, providing improved protection from the elements.

All of the features contained herein may be combined with any of the above aspects in any combination.

For a better understanding of the invention, and to show how embodiments of the same may be carried into effect, reference will now be made, by way of example, to the following figures.

DESCRIPTION OF EMBODIMENTS

Figure 1:
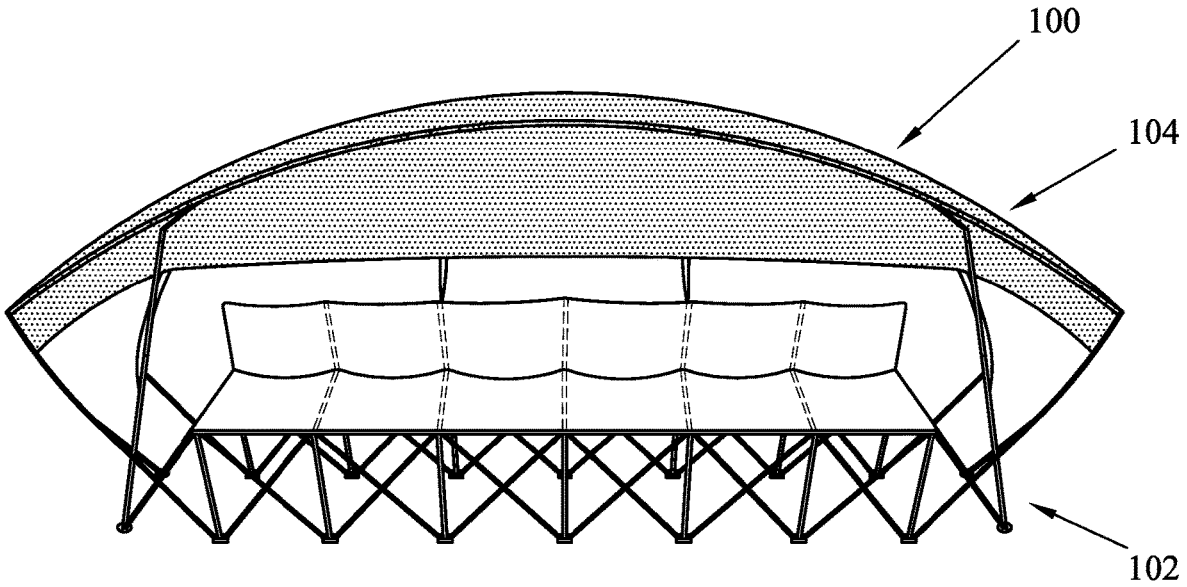
FIG. 1 shows a front view of an erect sheltered bench according to the present invention.
Figure 2:
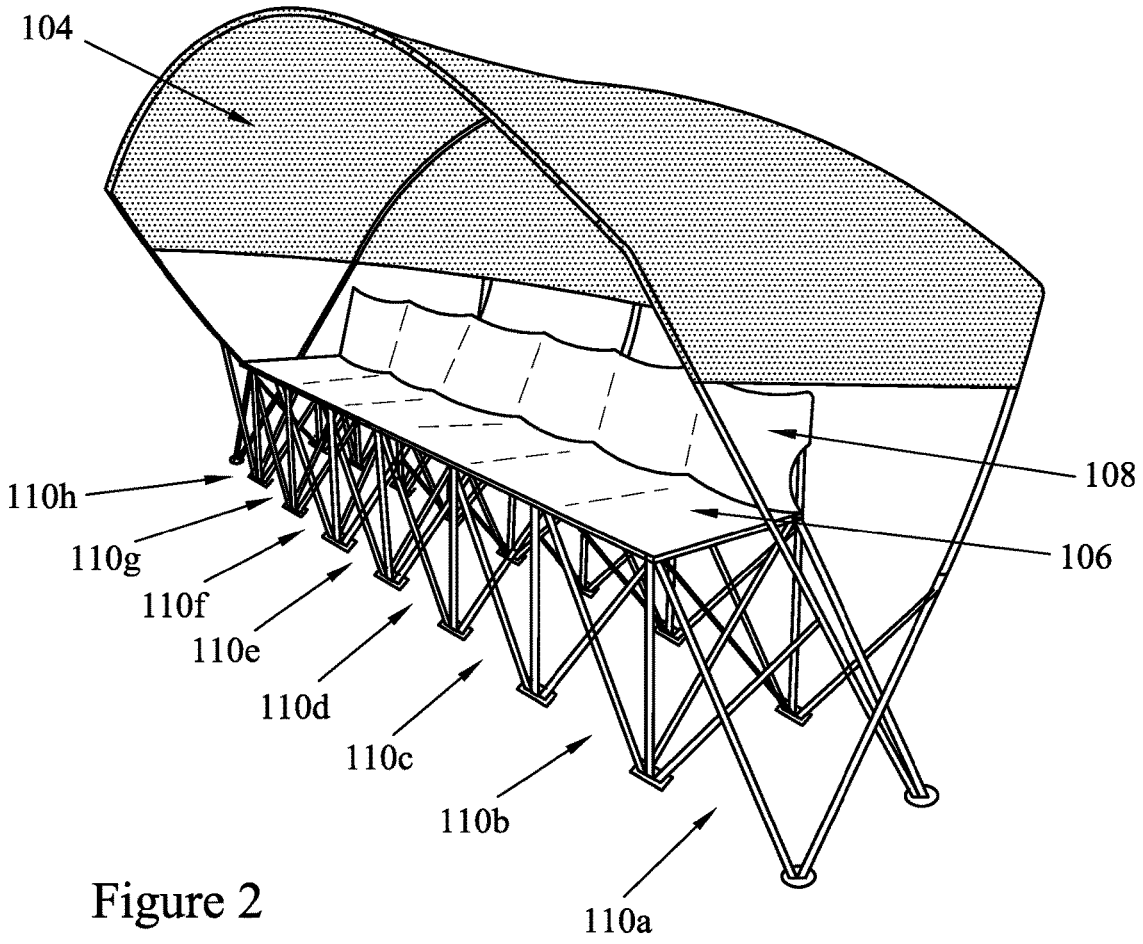
FIG. 2 shows a perspective front view of the erect sheltered bench of FIG. 1.

FIGS. 1 and 2 show erected sheltered bench 100 according to the present invention. Sheltered bench 100 is formed of collapsible base member 102 and collapsible canopy member 104.

Base member 102 is formed of bench sitting surface 106, bench backrest surface 108 and repeating base member support units 110*a-h*.

Each base member unit 110*a-h* has an open bottomed cuboidal shape, the sides walls of which are formed of a plurality of inflexible metal hollow cylindrical supporting members and joining members. Each of base member units 110*b-f* is formed of four vertical supporting members 124, one positioned on each vertical edge of the cuboidal shape; four pairs of pivotally attached support members 112, 114, 116, 117 wherein one pair extends along each vertical face of the cuboidal shape; and eight joining members 120, wherein one joining member is positioned on each vertex of the cuboidal shape. Support member pairs 112 and 114 extend longitudinally relatively to the longitudinal length of the sitting surface, with support member pair 112 forming the front face of the cuboidal shape and pair 114 forming the rear face of the cuboidal shape. Support member pairs 116 and 117 extend laterally relatively to the longitudinal length of the sitting surface, with support member pairs 116 and 117 extending along the side faces of the cuboidal shape. Repeating base member units 110*b-f* are fixedly attached in series such that base member support pairs 116, 117 are shared between adjacent units.

Each pair of supporting members 112, 114, 116, 117 are formed of two supporting members that are pivotally connected together about the midpoint of each member such that they can be in either an open or compact configuration: when in an open configuration the terminal ends of the members are spaced apart and the pair are in a cross-like configuration; when in a compact configuration the terminal ends of the members are relatively adjacent and the support members are substantially vertically orientated. When the base member is in an open configuration the support members of each pair 112, 114, 116, 117 are both in a slanted position, off-set 45° from the vertical. Pairs of supporting members are pivotally connected using pins 118 centred to mid-point of each supporting member.

Joining members 120 of units 110*b-g* are each pivotally attached to an end of one support member from each of two pairs of longitudinally extending support member pairs and an end of one support member from one laterally extending support member pair. In this way, the pairs of each unit at fixedly attached and adjacent units are attached.

Vertical support members 124, 126 extend vertically between upper and lower joining members 120 of the base support units 110*b-g*. Vertical support members form the vertical edges of the cuboidal shape of the base member units 110*b-g* such that each unit has two vertical support members on the front side of the sitting surface 124, and two vertical support members on the rear of the sitting surface 126. Adjacent base member units 110 share vertical supporting members 124, 126.

Front vertical supporting members 124 are fixed non-pivotally to the upper and lower joining members. Front vertical supporting members 124 are telescopic and able to move from a shorter retracted position when the base member unit is in an open configuration to a longer extended position when the base member unit is in a collapsed configuration.

Rear vertical supporting members 126 are not telescopic and the lower end is fixedly attached to the lower joining members only 120*b*. The upper end of the rear vertical supporting members extend slidably through and above the upper joining member 120*a* to provide a backrest support for bench backrest surface 108.

Bench sitting surface 106 is formed from pliable fabric which extends across the central six base member units 110*b-g* and has the same width as one base member unit. Outer base member units 110*a*, 110*h* are on either side of the terminal edge of bench seating area 106 and as such are not covered by the sitting surface. The bench sitting surface 106 is fixedly attached to the front upper joining members 120*a*. The bench sitting surface 106, is slidably attached to rear vertical support members.

Bench backrest surface 108 is formed from pliable fabric which is the same length as six base member units and in integrally formed with the bench sitting surface. The backrest surface 108 is formed of attachment members 109 which attach the backrest surface to the backrest support portion 127 formed by the portions of rear vertical support members 126 protruding above the upper joining members.

The outer base member units 110*a*, 110*h* are the same as base member units 110*b-g* except that they do not contain a vertical supporting member at all four vertical edges, but only at the connecting edges with the inner base member units 110*b* and 110*g*, respectively. Further, the outer laterally orientated slanted support member pair of units 110*a* and 110*h* extend above the upper joining members and are open ended to provide open ended bores 130 operable to function as canopy attachment members 128. Furthermore, the outer joining members of the units 110*a* and 110*h* are only attached to the ends of one longitudinally extending support member. Accordingly, base member 102 has four canopy attachment members 128, two each on opposing ends of the sitting surface 106. In the open position, canopy attachment members 128 are off-set 45° from the vertical in opposite directions. Slanted bore 130*a-d* is each able to receive an end of a support member of the canopy 134, 136.

Canopy member 104 in formed of two canopy support members 134, 136 and cover 148

Canopy support members 134, 136 are collapsible along their longitudinal length. In a dissembled configuration the length of the canopy support members 134, 136 have a significantly reduced longitudinal length compared to an assembled configuration. Support members 134 and 136 are each formed of a plurality of stiff linear flexiglass portions 142*a-g* each being of substantially the same length. Portions 142*a-g* are reversibly attachable in series using ferrules 140, in which each ferrule has a first open end and a second open end operable to receive the end of a portion 142*a-g*. Each end of portions 142*a-g* are elastically attached to one end of a respective ferrule 140, except for one end of each of portions 142*a* and 142*g*. In the collapsed configuration, one end of each portion 142*b-f* are removed from a ferrule to allow the support member to be collapsed along the longitudinal length. When in an assembled configuration, but not attached to the base member, canopy support members 134, 136 form three linear portions: two linear end portions 137 and one linear intermediate portion 139. Two curved ferrules, one provided at each of one end of portions 140*a* and 140*g* provide an assembled support member in which the longitudinal axis of the linear end portions are arranged off-set relative to the longitudinal axis of the linear intermediate portion.

When canopy member 104 is attached to base member 102, opposing ends of canopy support members 134, 136 are each inserted into bores 130*a* and 130*c*, and 130*b* and 130*d* respectively. Canopy support member 134 is attached to the two slanted bores 130*a* and 130*c* and canopy support member 136 is attached to the two slanted bores 130*b* and 130*d* such that canopy support members 135 and 136 extend from a first side of the sitting surface to a second substantially opposed side of the sitting surface along opposite sides of the longitudinal axis of the sitting surface. Canopy support members when assembled require a small longitudinal deformation to fit into the slanted bores and accordingly, are held under tension along the longitudinal lengths of the support members when attached to the base member.

Figure 14:
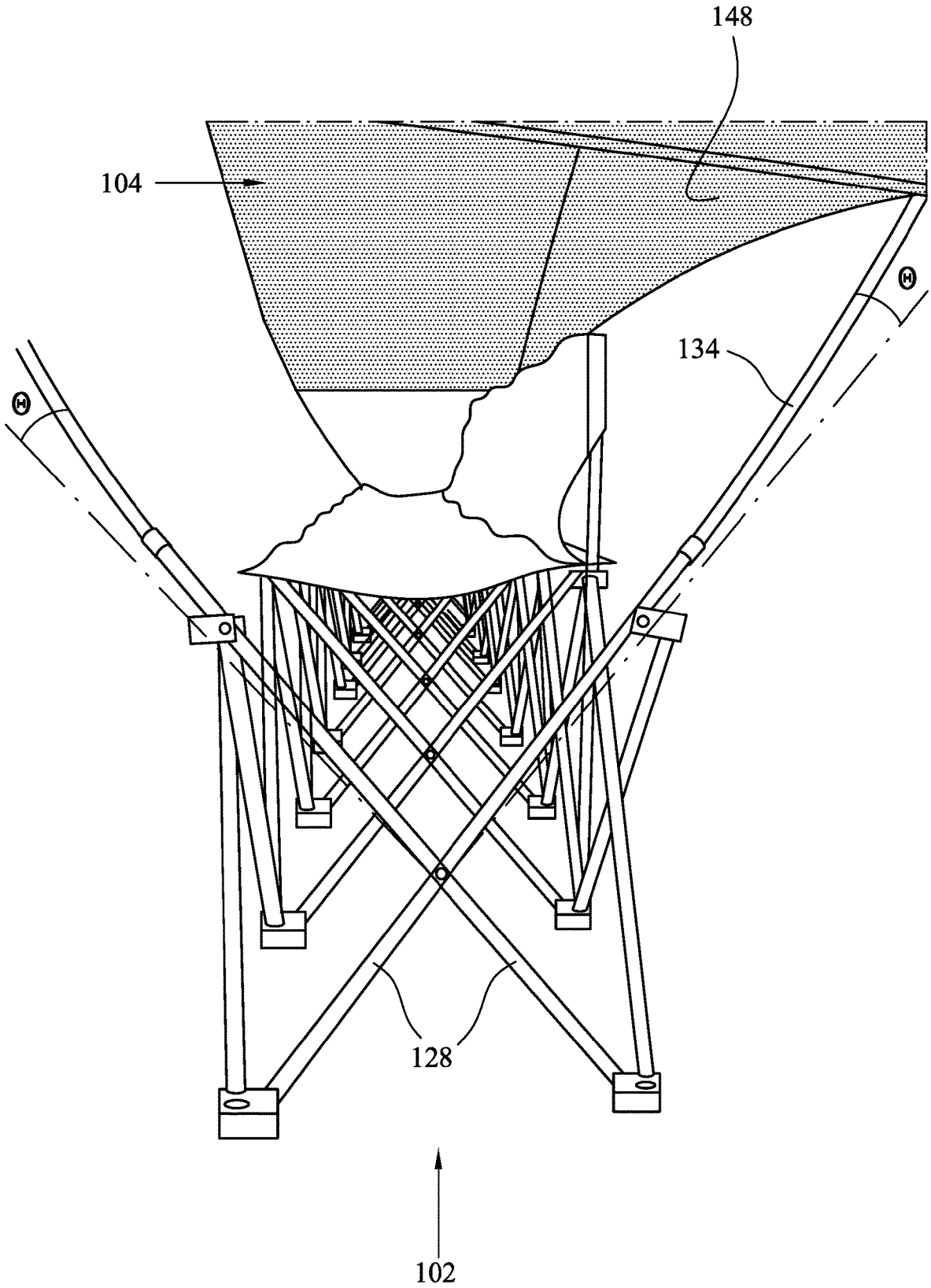
FIG. 14 shows an enlarged side perspective view of the erect sheltered bench of FIG. 1.
Figure 15:
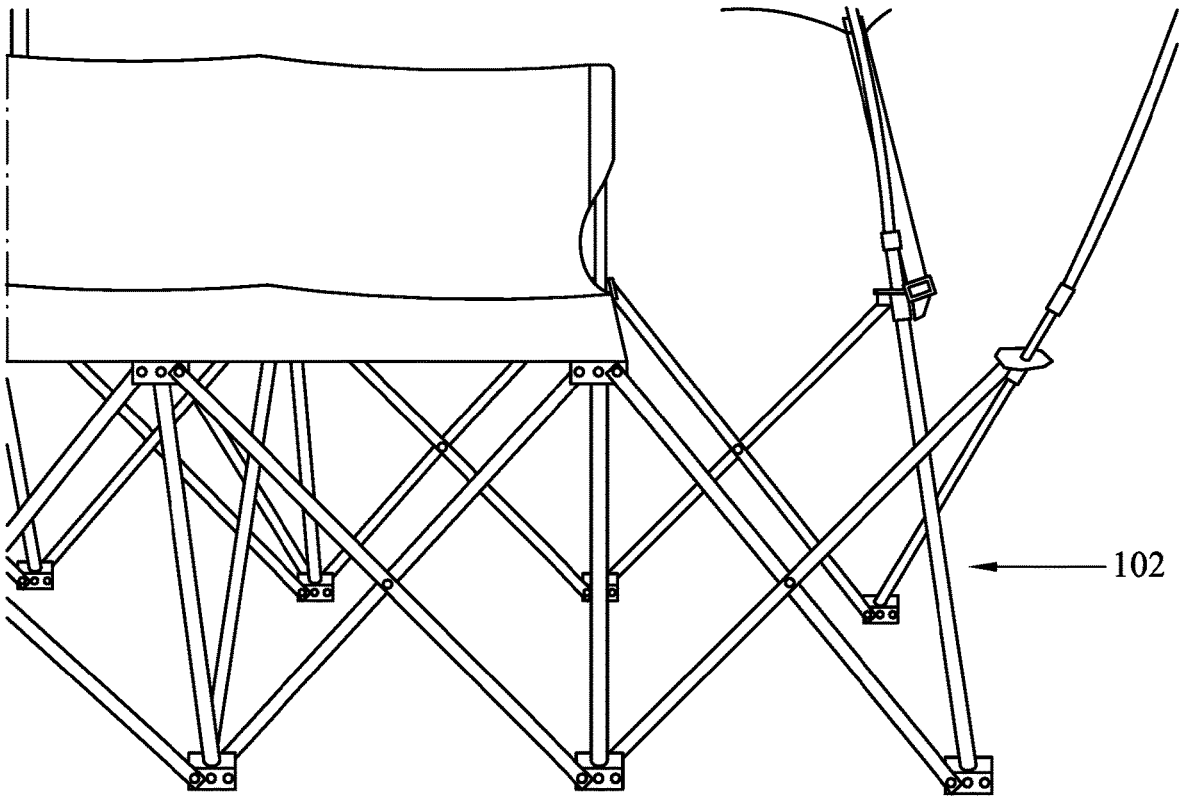
FIG. 15 shows an enlarged from front view of the erect sheltered bench of FIG. 1.
Figure 16:
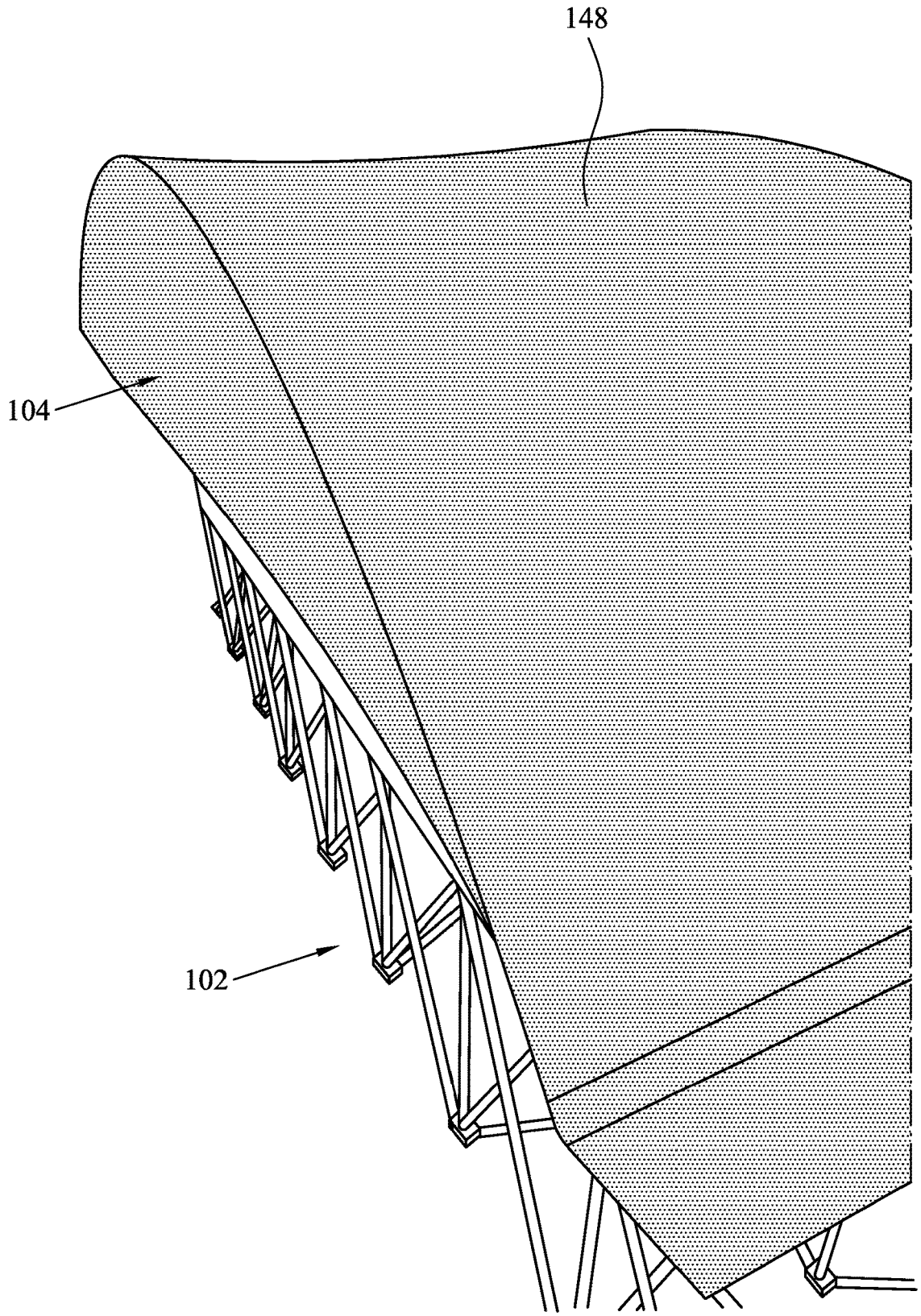
FIG. 16 shows a perspective rear view of the erect sheltered bench of FIG. 1.

Canopy support member 134 is reversibly attached to cover 148 along substantially all of the intermediate portion of the support member in the erect configuration using cover attachment members 150. Cover 148 is also reversibly attached to base member 102 using base attachment member clips 152. In the erect configuration cover 148 extends from support member 134 over support member 136 and is clipped to the rear of base member 102. In this configuration, the cover extends from beyond the front edge of the sitting surface, over the sitting surface to beyond the rear edge of the sitting surface and is held under tension. The lateral tension required to attach the canopy member 104 to the base member 102 results in the end portions of canopy support members 134, 136 being off-set compared to the longitudinal axis of the bores of canopy attachment members 128. The angle off-set compared is shown as theta in FIG. 14. As such, in the erect configuration canopy support members are held under lateral tension by holding the support members against the bias of the support members toward a greater lateral separation between the support members along their longitudinal lengths. The cover also extends from the canopy attachment members 130*a,b* over the sitting surface to attachment members 130*c,d* under tension.

Figure 3:
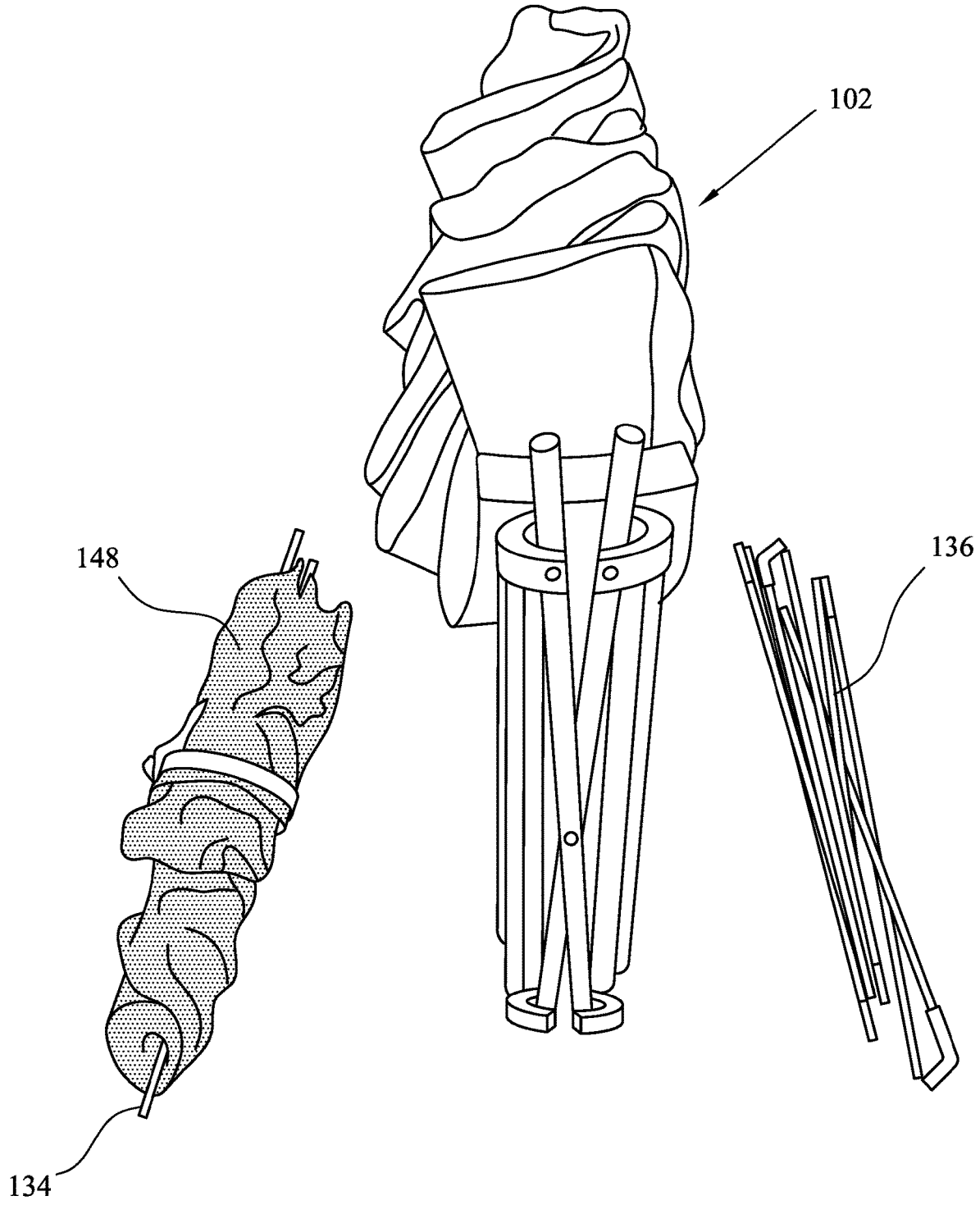
FIG. 3 shows the sheltered bench of FIG. 1 in a collapsed configuration, with base member and canopy member in a collapsed configuration.
Figure 4:
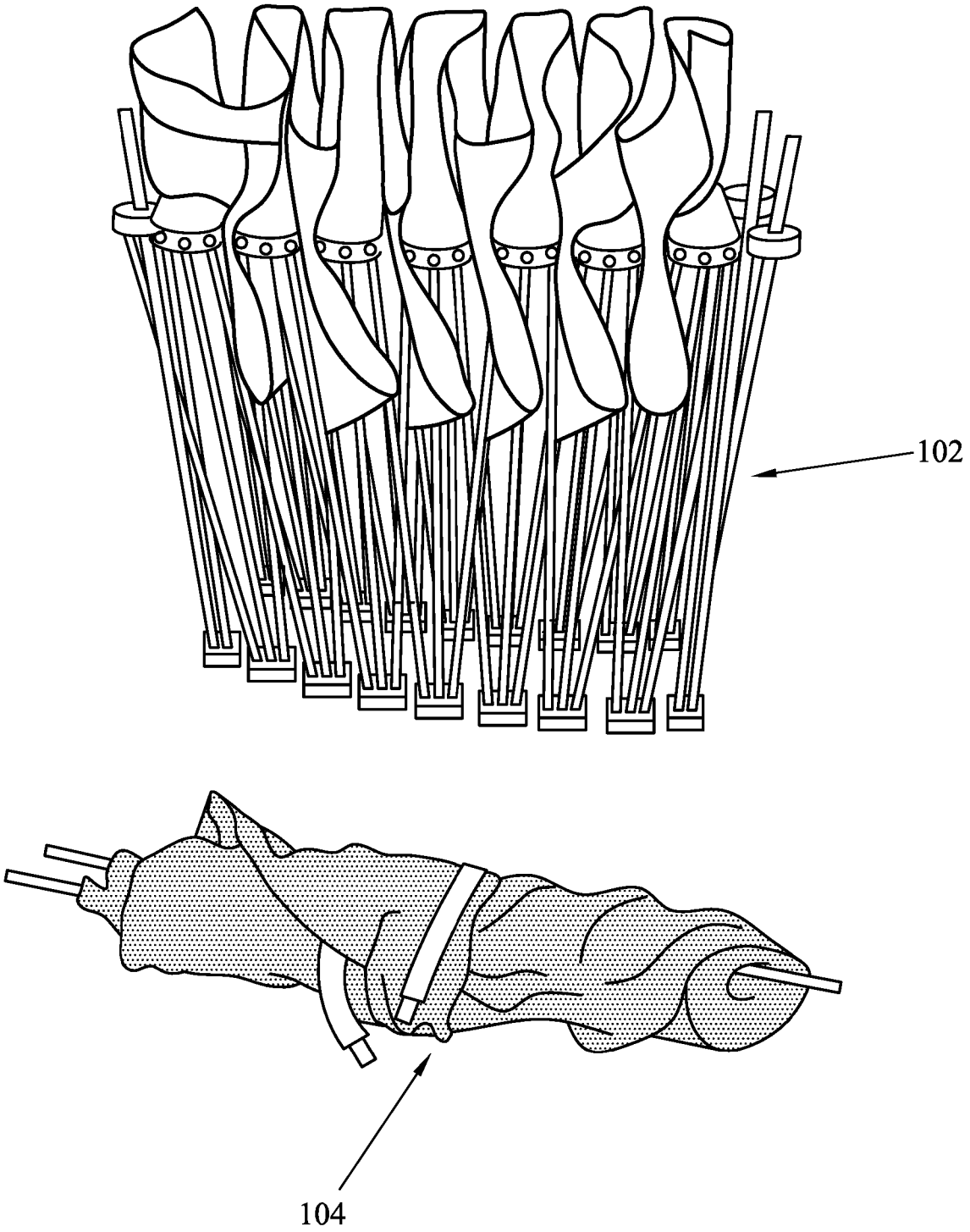
FIG. 4 shows a front view of the sheltered bench of FIG. 1 in a collapsed configuration, with a front view of the collapsed base member of FIG. 3.
Figure 5:
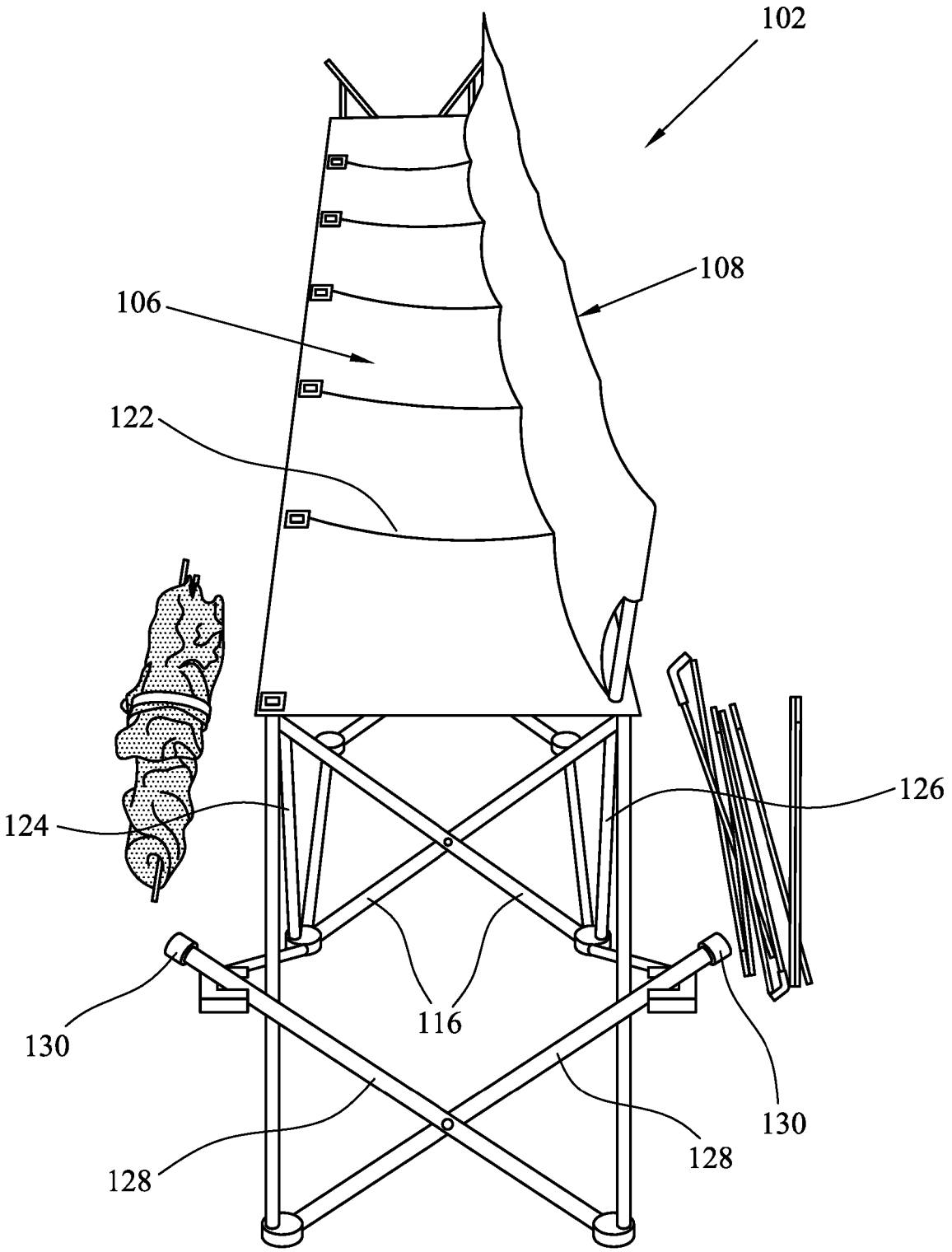
FIG. 5 shows a side view of the base member of FIG. 3 in the open configuration.
Figure 6:
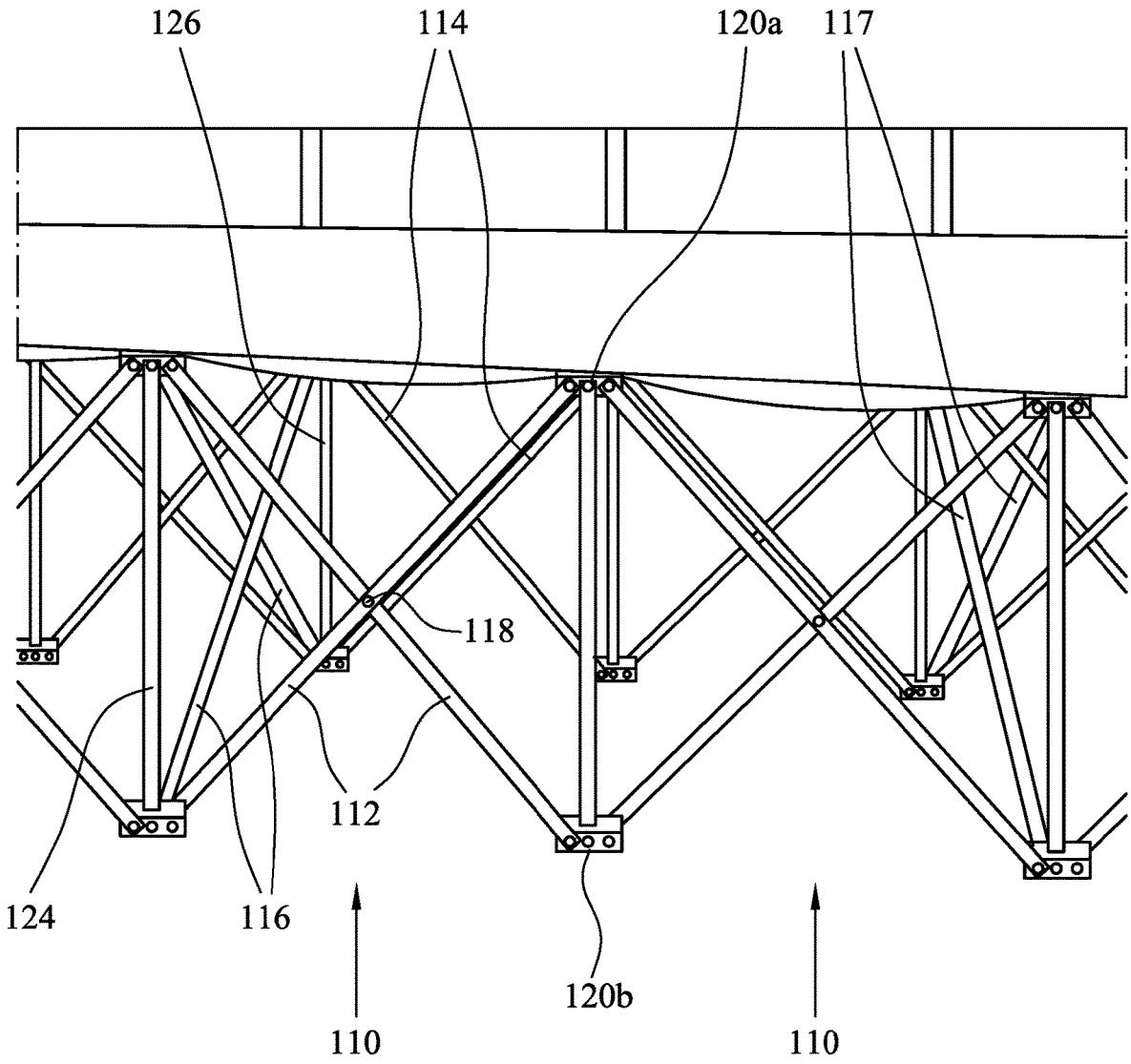
FIG. 6 shows an enlarged front view of the repeating base member support units of the base member of FIG. 5.
Figure 7:
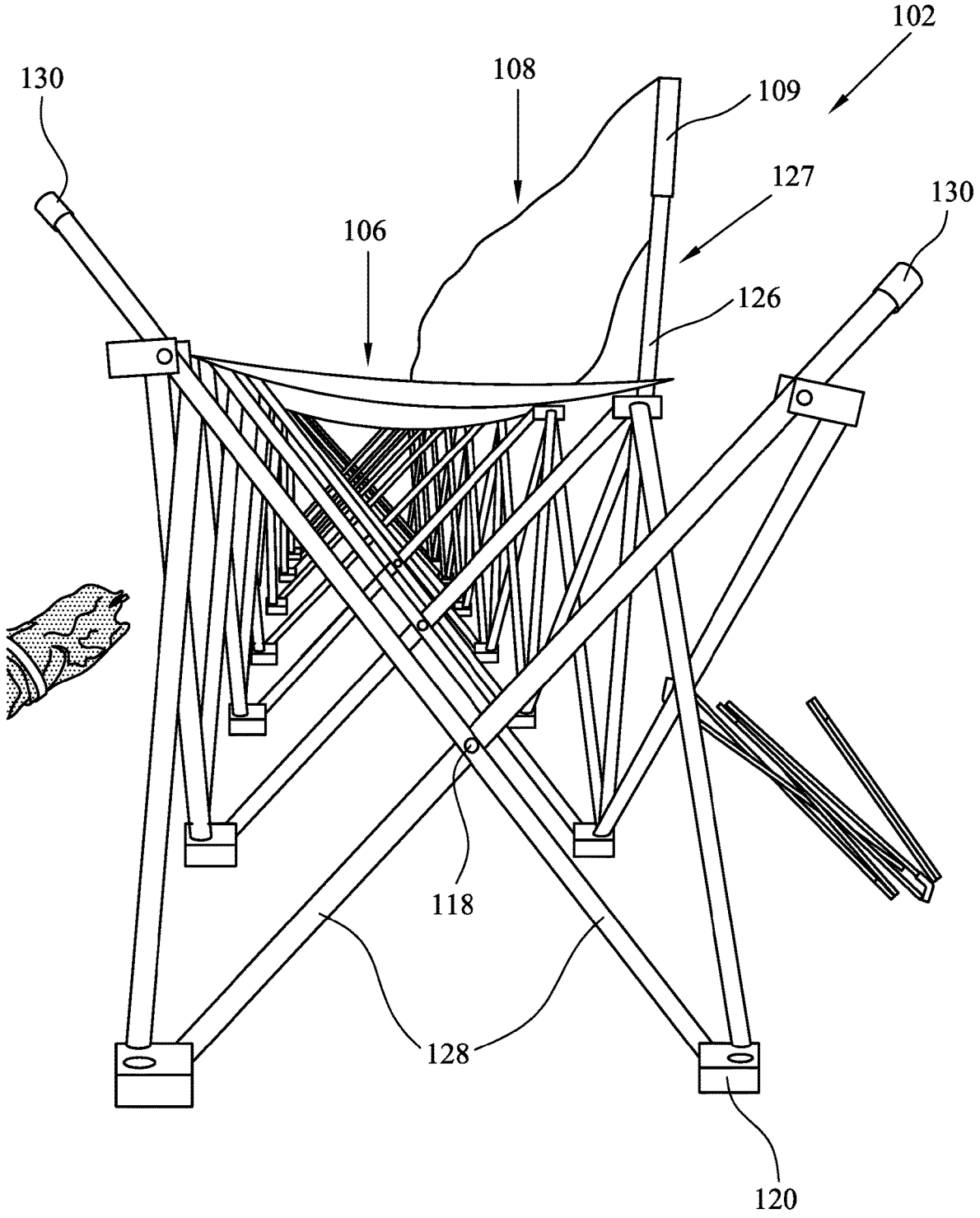
FIG. 7 shows an enlarged side view of the canopy attachment members of the base member of FIG. 5.
Figure 8:
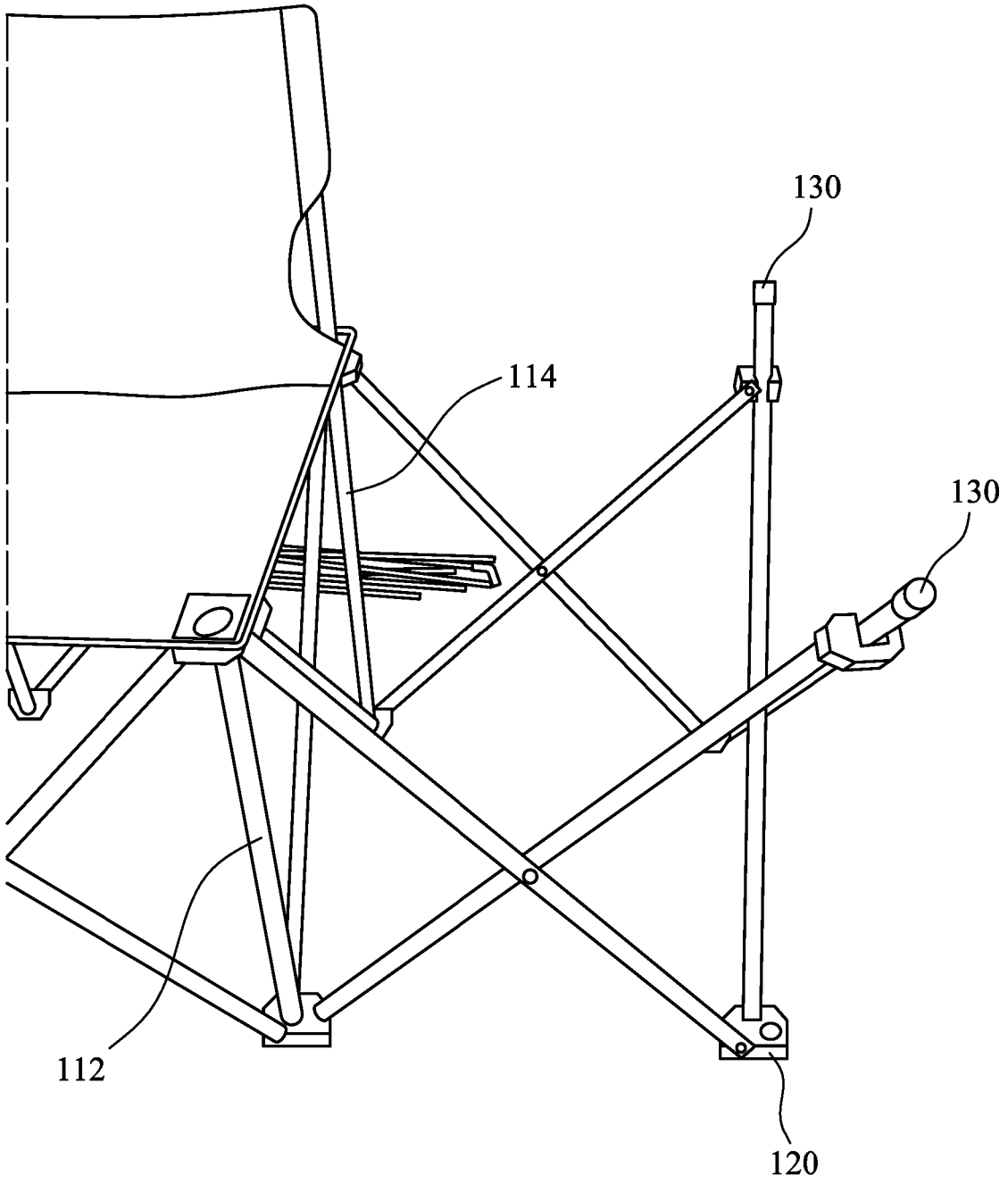
FIG. 8 shows a enlarged front view of the canopy attachment members of the base member of FIG. 5
Figure 9:
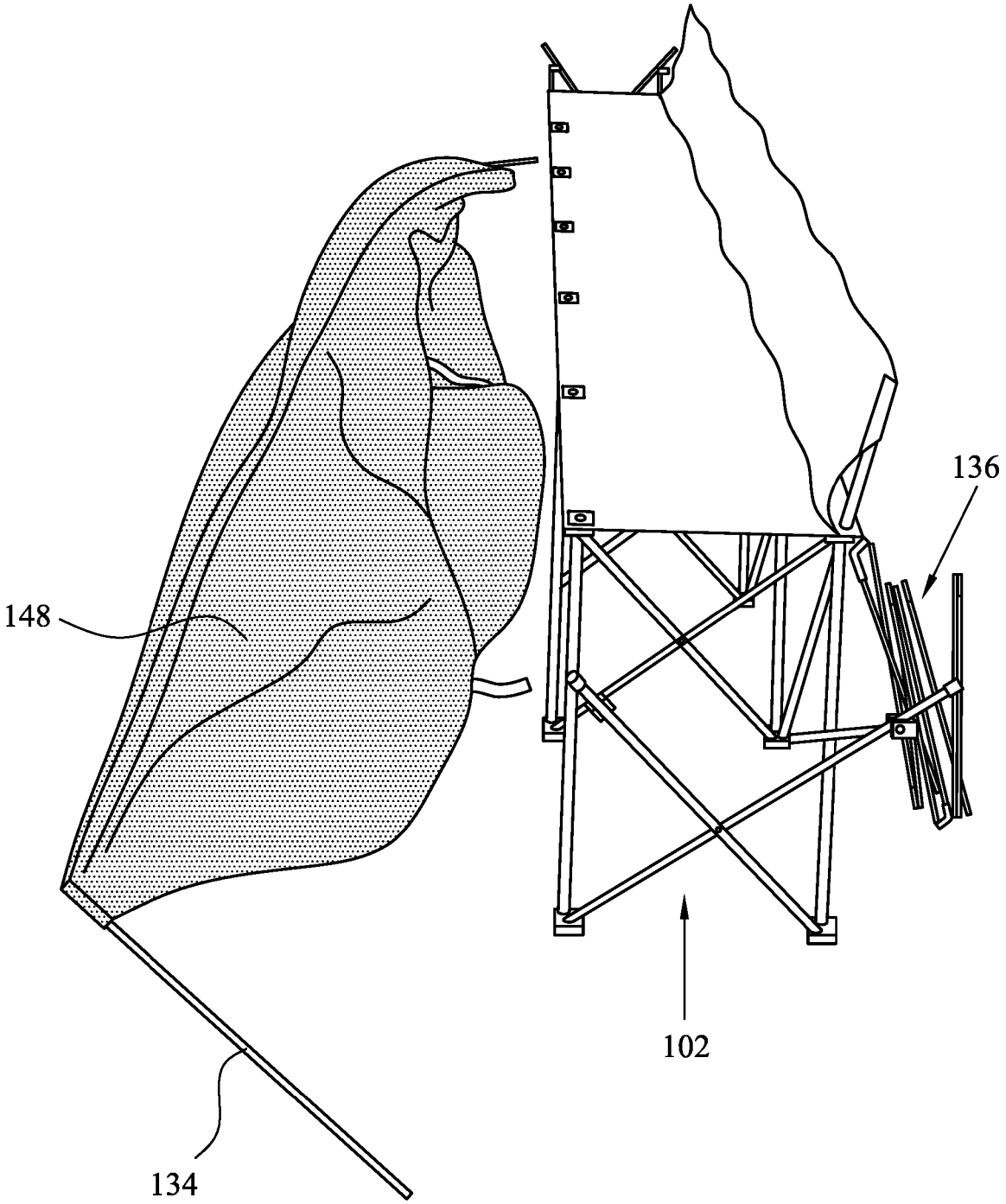
FIG. 9 shows a side perspective view of the base member of FIG. 5 and an assembled first support member of the canopy member of FIG. 1.
Figure 10:
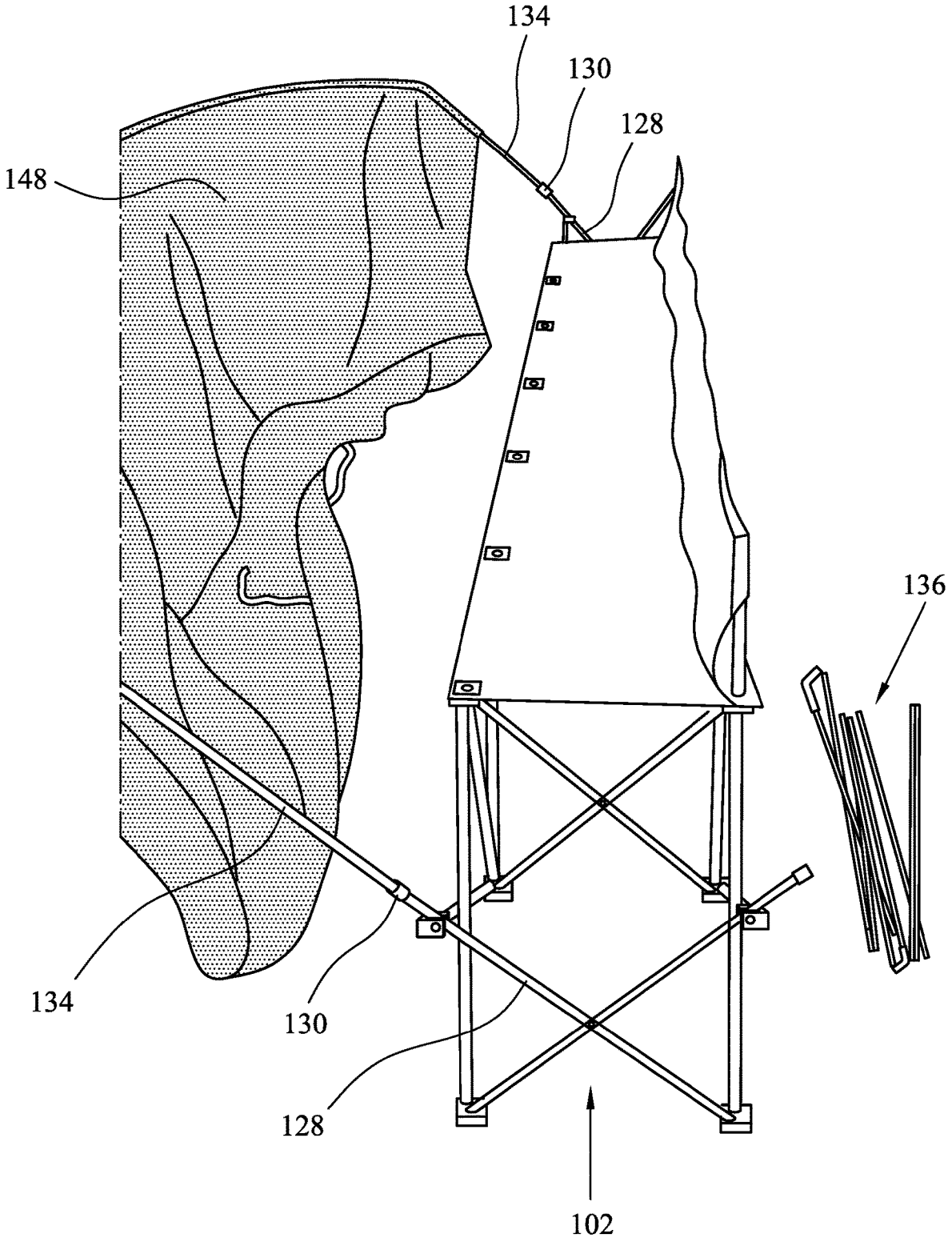
FIG. 10 shows a side perspective view of an assembled first support member of the canopy attached to the open base member of the sheltered bench of FIG. 1.
Figure 11:
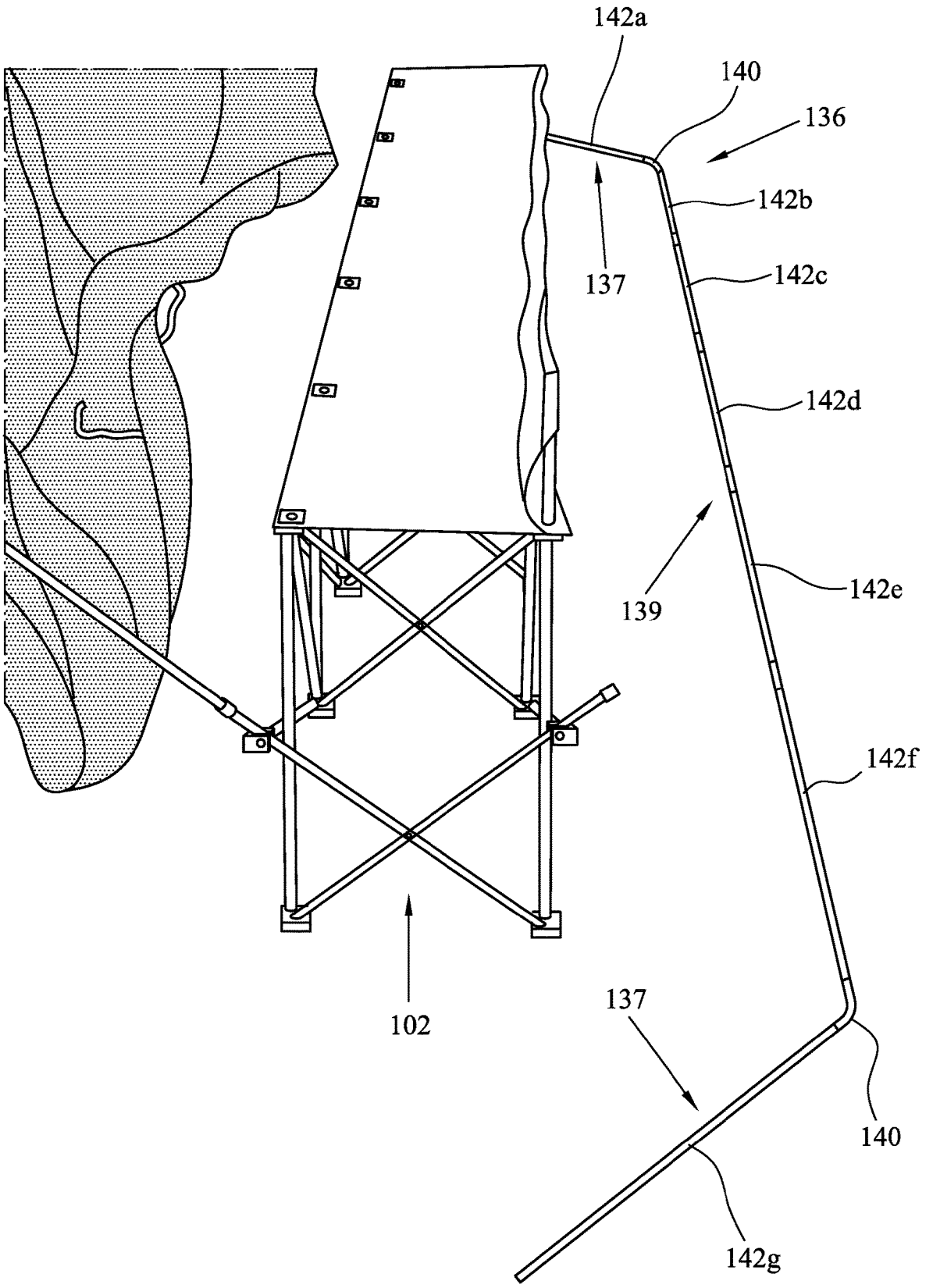
FIG. 11 shows a side perspective view of the base member of FIG. 5 and of an assembled second support member of the canopy member of FIG. 1.
Figure 12:
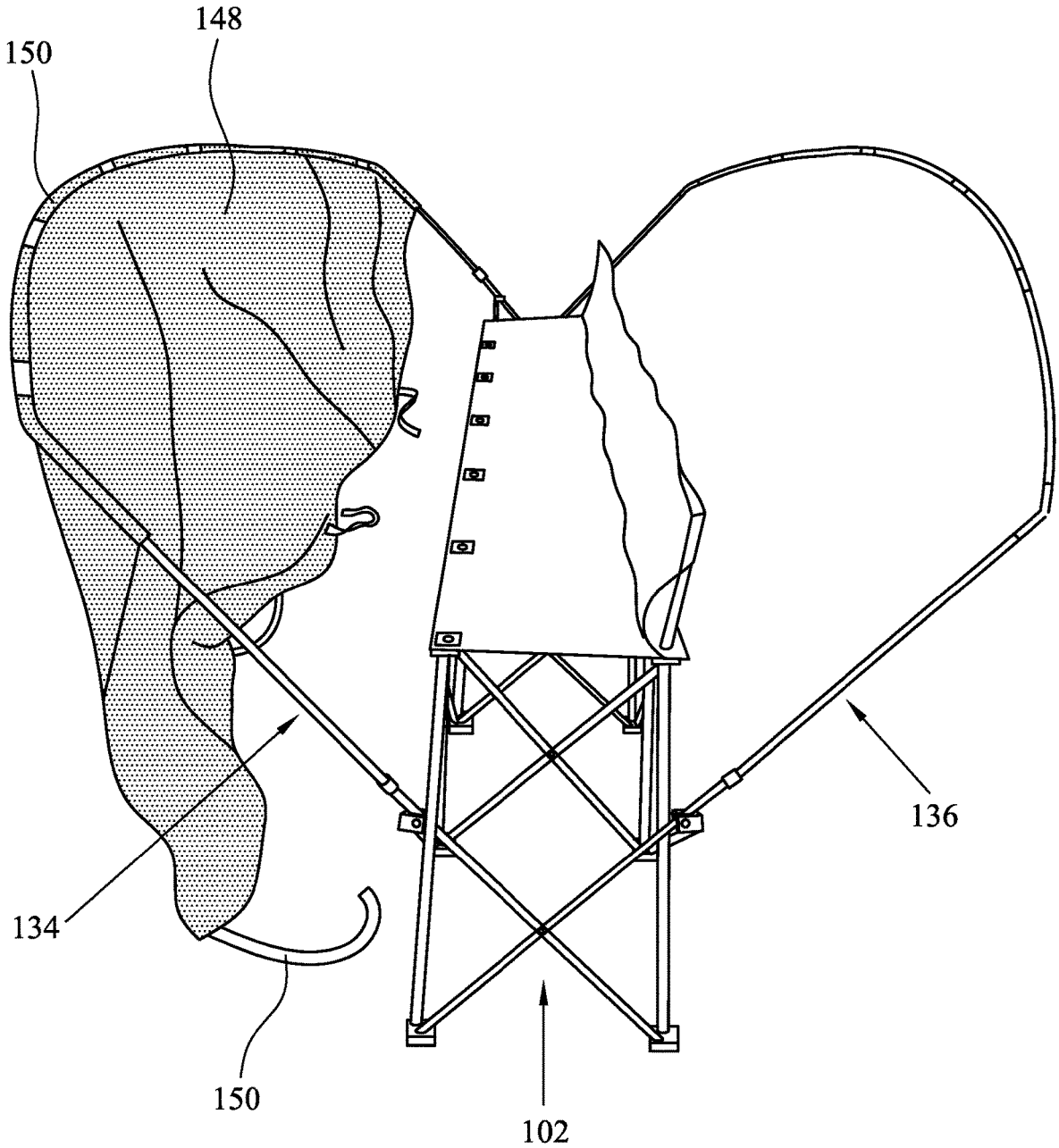
FIG. 12 a side perspective view of the assembled first support member of the canopy member and second support member of the canopy member attached to the open base member of the sheltered bench of FIG. 1.
Figure 13:
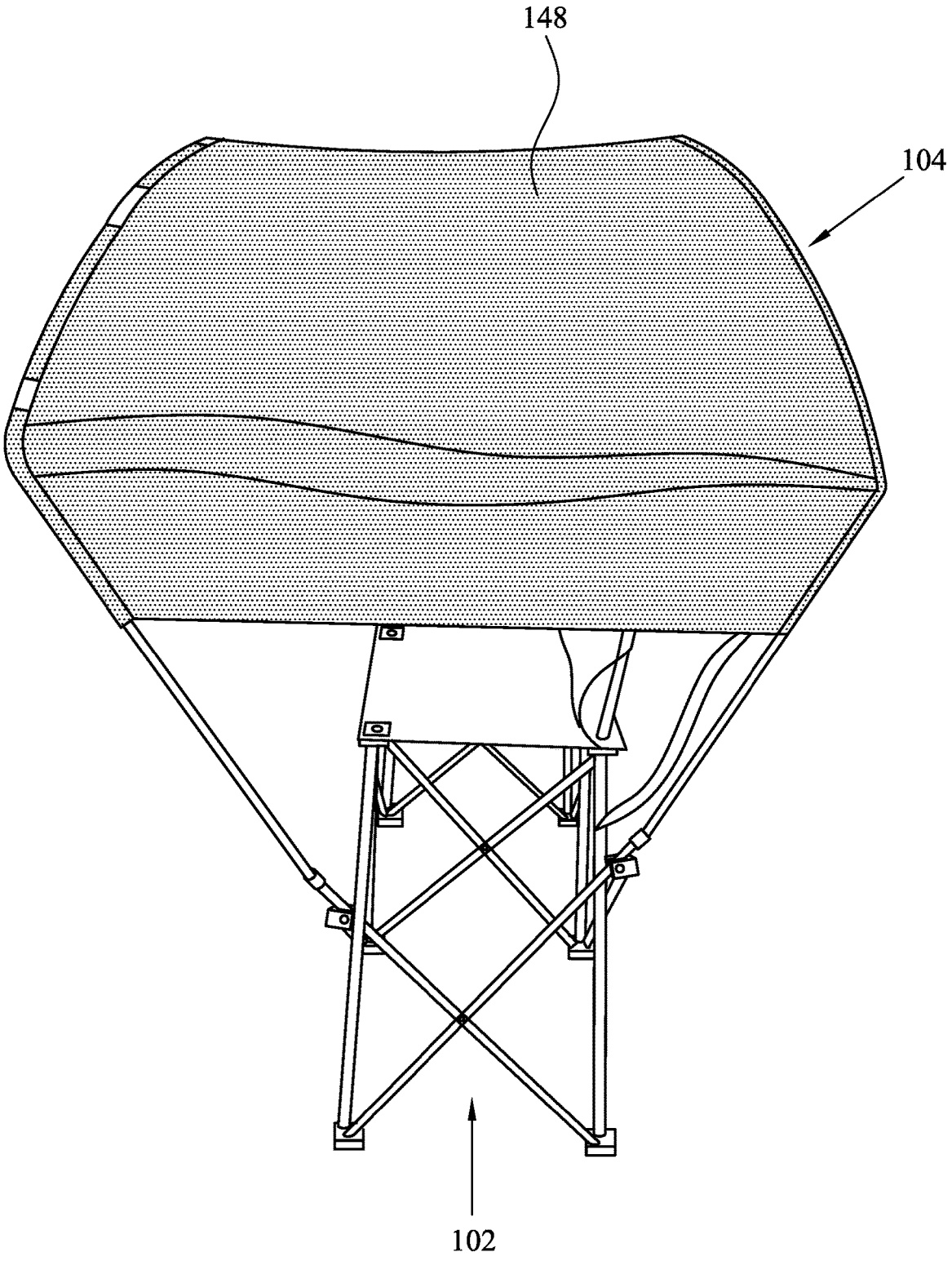
FIG. 13 shows a side perspective view of the erect sheltered bench of FIG. 1.

As shown by FIGS. 3 to 16, the collapsed sheltered bench apparatus shown in FIG. 3 may be assembled into an erect configuration by folding base member 102 into the open configuration (FIG. 5) and assembling the canopy support members 134 and 136 before inserting the ends of the support members into the respect canopy attachment members of the base member (FIGS. 9 to 12) to place the support members under longitudinal tension. The cover 148 of the canopy member can then be arranged over support member 136 and attached to the rear of the base member to secure the cover in position and place the support members under lateral tension to thereby hold the cover under tension over the sitting surface (FIGS. 12 to 16).

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/ or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A collapsible sheltered bench operable to have a first collapsed configuration and a second erect configuration, the collapsible sheltered bench comprising a base member comprising a bench sitting surface, and a canopy member comprising first and second support members and a cover, wherein in the erect configuration the first and second support members extend from a first side of the sitting surface to a second substantially opposed side of the sitting surface along opposite sides of a longitudinal axis of the sitting surface, and wherein the first and second support members support the cover such that the cover extends over at least a portion of the sitting surface, wherein the base member comprises a plurality of repeating support units, wherein the first and second canopy support members are under longitudinal and lateral tension in the erect configuration, wherein the base member comprises a first canopy attachment member operable to form an attachment with the first canopy support member and a second canopy attachment member operable to form an attachment with the second canopy support member, and wherein the first and second canopy attachment members each comprise a bore operable to receive a projection of the respective canopy member, wherein the longitudinal axis of the bores of the first and second canopy attachment members are slanted when the collapsible sheltered bench is in the erect configuration, wherein, in the erect configuration, the cover comprises a front edge that extends from beyond the front edge of the sitting surface, and further comprises a rear edge that extends beyond the rear edge of the sitting surface.

2. The collapsible sheltered bench according to claim 1, wherein the base member is a collapsible base member operable to be moved from a first open position in which the sitting surface is suitable for sitting to a second collapsed position in which the base member is compact compared to the first position.

3. The collapsible sheltered bench according to claim 1, wherein the support units of the base member each comprise at least two pairs of support members wherein the support members of each pair are pivotally connected together such that each pair of support members are operable to move from a spaced configuration in the first open position of the base member to an adjacent configuration in the second compact position.

4. The collapsible sheltered bench according to claim 1, wherein the support units each comprise a first longitudinally extending pivotally connected pair of support members and a first laterally extending pivotally connected pair of support members, with respect to the sitting surface.

5. The collapsible sheltered bench according to claim 1, wherein the base member comprises joining members operable to attach pairs of support members within a support unit and optionally also to attach adjacent support units, suitably, the joining members comprising pivotal connections.

6. The collapsible sheltered bench according to claim 5, wherein the base member further comprises vertical support members extending between joining members.

7. The collapsible sheltered bench according to claim 1, wherein the sitting surface is a pliable sitting surface.

8. The collapsible sheltered bench according to claim 1, wherein the base member and the canopy member are operable to form a reversible attachment.

9. The collapsible sheltered bench according to claim 1, wherein the base member comprises at least two canopy attachment members arranged at substantially opposite sides of the sitting surface in the erect configuration.

10. The collapsible sheltered bench according to claim 1, wherein the base member comprises a first and a second canopy attachment member at a first side of the sitting surface and a third and a fourth canopy attachment member at a second side of the sitting surface.

11. The collapsible sheltered bench according to claim 10, wherein the first and second canopy attachment members of the base member, and/or the third and fourth canopy attachment members of the base member, are off-set from vertical by substantially the same amount.

12. The collapsible sheltered bench according to claim 1, wherein the first and/or second support members of the canopy member each comprise base member attachment portions operable to form an attachment with the canopy attachment members of the base member in the erect configuration.

13. The collapsible sheltered bench according to claim 1, wherein the first and/or second canopy support members are operable to be collapsed along the longitudinal length.

14. The collapsible sheltered bench according to claim 1, wherein the cover of the canopy member is pliable.

15. The collapsible sheltered bench according to claim 1, wherein the cover is operable to be held under tension in the erect configuration.

16. A kit of parts for a collapsible sheltered bench operable to have a first collapsed configuration and a second erect configuration, the kit of parts comprising a base member comprising a bench sitting surface, a canopy member comprising first and second support members and a cover, wherein the canopy member is operable to form a reversible attachment with the base member to provide a cover over at least a portion of the sitting surface of the base member, wherein in the erect configuration the first and second support members extend from a first side of the sitting surface to a second substantially opposed side of the sitting surface along opposite sides of the longitudinal axis of the sitting surface, and wherein the first and second support members support the cover such that the cover extends over at least a portion of the sitting surface, wherein the base member comprises a plurality of repeating support units, wherein the first and second canopy support members are under longitudinal and lateral tension in the erect configuration, wherein the base member comprises a first canopy attachment member operable to form an attachment with the first canopy support member and a second canopy attachment member operable to form an attachment with the second canopy support member, and wherein the first and second canopy attachment members each comprise a bore operable to receive a projection of the respective canopy member, wherein the longitudinal axis of the bores of the first and second canopy attachment members are slanted when the collapsible sheltered bench is in the erect configuration, wherein, in the erect configuration, the cover comprises a front edge that extends from beyond the front edge of the sitting surface, and further comprises a rear edge that extends beyond the rear edge of the sitting surface.

* * * * *